US008164400B2

(12) United States Patent
Iwata et al.

(10) Patent No.: US 8,164,400 B2
(45) Date of Patent: Apr. 24, 2012

(54) DISTRIBUTED CONSTANT TYPE FILTER DEVICE

(75) Inventors: Hideki Iwata, Shinagawa (JP); Masahiro Yanagi, Shinagawa (JP); Shigemi Kurashima, Shingawa (JP); Takashi Yuba, Shingawa (JP); Masahiro Kaneko, Shinagawa (JP); Yuriko Segawa, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 292 days.

(21) Appl. No.: 11/589,167

(22) Filed: Oct. 30, 2006

(65) Prior Publication Data

US 2007/0262832 A1 Nov. 15, 2007

(30) Foreign Application Priority Data

May 10, 2006 (JP) ..... 2006-131700

(51) Int. Cl.
*H01P 1/203* (2006.01)
*H01P 7/08* (2006.01)

(52) U.S. Cl. ..... 333/204; 333/219; 343/700 MS

(58) Field of Classification Search ..... 333/204, 333/205, 219; 343/700 MS
See application file for complete search history.

(56) References Cited

U.S. PATENT DOCUMENTS

| | | | | |
|---|---|---|---|---|
| 5,717,232 | A * | 2/1998 | Inoue et al. | 257/283 |
| 5,861,782 | A * | 1/1999 | Saitoh | 333/239 |
| 5,880,656 | A * | 3/1999 | Yabuki et al. | 333/204 |
| 5,923,232 | A * | 7/1999 | Europa et al. | 333/204 |
| 6,512,427 | B2 * | 1/2003 | Nakano | 333/132 |
| 6,727,785 | B2 | 4/2004 | Killen et al. | |
| 6,995,632 | B2 * | 2/2006 | Saito et al. | 333/175 |
| 7,528,687 | B2 | 5/2009 | Inoue et al. | |
| 2004/0000960 | A1 * | 1/2004 | Killen et al. | 333/33 |
| 2004/0000976 | A1 * | 1/2004 | Killen et al. | 333/219 |
| 2005/0242905 | A1 * | 11/2005 | Inoue et al. | 333/204 |
| 2007/0035360 | A1 * | 2/2007 | Benham | 333/117 |
| 2007/0063794 | A1 * | 3/2007 | Araki et al. | 333/204 |
| 2008/0049407 | A1 * | 2/2008 | Ohmi et al. | 361/771 |

FOREIGN PATENT DOCUMENTS

| | | | |
|---|---|---|---|
| JP | 2004-048737 | | 2/2004 |
| JP | WO2004105175 | * | 2/2004 |
| JP | 2005-295316 | | 10/2005 |
| JP | 2005-318428 | | 11/2005 |

OTHER PUBLICATIONS

Japanese Office Action dated Dec. 8, 2009 for copending Japanese Patent Application No. 2006-131700.

* cited by examiner

*Primary Examiner* — Benny Lee
*Assistant Examiner* — Gerald Stevens
(74) *Attorney, Agent, or Firm* — Staas & Halsey LLP

(57) ABSTRACT

A distributed constant type filter includes a substrate including a part made of a first dielectric material having a first relative dielectric constant and a different-material part made of a second dielectric material having a second relative dielectric constant different from the first relative dielectric constant. A filter pattern is formed on a top surface and a ground pattern is formed on a bottom surface of the substrate. Part of the filter pattern is formed on the different-material part.

4 Claims, 12 Drawing Sheets

11
OUT
14a(Z3)
W1
IN 10A
11A
11Aa
(ε r0)
OUT
W2
15
Z2=100Ω
(Z2)
13c
(Z2)
13b
(Z1)
13a
20
(ε r1)
IN
13
14A
(Z3)
12A
ε r1 < ε r0

10A
20
(ε r1)
11Ab
14A
15

11
OUT
14b(Z3)
W3
IN 10B
11B
OUT
11Ba
(εr1)
W4
(Z2)
13c
(Z2)
13b
(Z1)
13a
IN
15
50
(εr2)
Z3=10Ω
13
14B
(Z3)
12B
εr2 > εr1

10B
50
(εr2)
11Bb
14B
15

DISTRIBUTED CONSTANT TYPE FILTER DEVICE

BACKGROUND OF THE INVENTION

1. Field of the Invention

The present invention relates generally to distributed constant type filter devices, and more particularly to a distributed constant type filter device applied to a flat panel antenna device using UWB (ultra-wide band).

2. Description of the Related Art

FIGS. 1A, 1B are schematic diagrams of a conventional ring filter device 10, which is a distributed constant type filter device. The ring filter device 10 includes a substrate 11 made of epoxy resin. A ring filter element 12 having an open stub is arranged on a top surface 11*a* of the substrate 11. A ground pattern 15 entirely covers a bottom surface 11*b* of the substrate 11.

The ring filter element 12 having the open stub includes a ring part 13 and an open stub part 14. The ring part 13 includes a first transmission line 13*a* having a length λ/2, and two second transmission lines 13*b*, 13*c*, each having a length λ/4. It is assumed that λ corresponds to a wavelength of a frequency f0. The impedance of the first transmission line 13*a* is Z1, the impedance of the second transmission lines 13*b*, 13*c* is Z2, and the impedance of the open stub part 14 is Z3.

The ring filter device 10 has a transmission property as shown in FIG. 2, with two attenuation pole frequencies f1, f2. A frequency band between the two attenuation pole frequencies f1, f2 is denoted by "A".

The attenuation pole frequencies f1, f2 are determined by ratios between the impedance Z1 of the first transmission line 13*a*, the impedance Z2 of the second transmission lines 13*b*, 13*c*, and the impedance Z3 of the open stub part 14.

By decreasing the impedance Z3 of the open stub part 14, the frequency band A becomes wide; by increasing the impedance Z3, the frequency band A becomes narrow.

There are a variety of commercialized products with different frequency bands A that can be employed as the ring filter device 10. Thus, according to the product employed as the ring filter device 10, the impedance Z3 of the open stub part 14 has an appropriate value in the range of 10Ω through 100Ω. The ring filter device 10 is manufactured so that the open stub part 14 is designed to have predetermined impedance Z3.

Patent Document 1: Japanese Laid-Open Patent Application No. 2005-295316

In the conventional ring filter device 10, the impedances Z1, Z2, Z3 are determined by parameters such as a relative dielectric constant (∈r0) of epoxy resin used as the material for the substrate 11, the thickness of the substrate 11, etc.

The impedance Z3 is specifically described herein. For example, when the impedance Z3 is decreased to 10Ω in order to widen the frequency band A, the width W of the open stub part 14 is extremely wide, such as 20 mm. Conversely, when the impedance Z3 is increased to 100Ω in order to narrow the frequency band A, the width W of the open stub part 14 is extremely narrow, such as 0.1 mm.

Thus, in order to make the open stub part 14 have an appropriate width W, the impedance Z3 of the open stub part 14 is selected to be within a range narrower than 10Ω through 100Ω. This limits the freedom in the design of the ring filter device 10.

SUMMARY OF THE INVENTION

The present invention provides a distributed constant type filter device in which one or more of the above-described disadvantages is eliminated.

An embodiment of the present invention provides a distributed constant type filter including a substrate including a part made of a first dielectric material having a first relative dielectric constant and a different-material part made of a second dielectric material having a second relative dielectric constant different from the first relative dielectric constant; a filter pattern formed on a top surface of the substrate; and a ground pattern formed on a bottom surface of the substrate; wherein part of the filter pattern is formed on the different-material part.

An embodiment of the present invention provides a distributed constant type filter including a substrate made of a dielectric material, the substrate including a glass cloth part that includes a glass cloth and a glass-cloth-free part that does not include the glass cloth; a filter pattern formed on a top surface of the substrate; and a ground pattern formed on a bottom surface of the substrate; wherein part of the filter pattern is formed on the glass-cloth-free part.

An embodiment of the present invention provides a distributed constant type filter including a substrate made of a dielectric material; a filter pattern formed on a top surface of the substrate; and a ground pattern formed on a bottom surface of the substrate; wherein the filter pattern includes a ring part and an open stub part connected to the ring part, and the open stub part extends from the ring part inward to an interior of the circle of the ring part.

An embodiment of the present invention provides a flat panel antenna device including a substrate including a part made of a first dielectric material having a first relative dielectric constant and a different-material part made of a second dielectric material having a second relative dielectric constant different from the first relative dielectric constant; an antenna element pattern and a filter pattern formed on a top surface of the substrate; and a ground pattern formed on a bottom surface of the substrate; wherein part of the filter pattern is formed on the different-material part.

According to one embodiment of the present invention, the dimension of a filter pattern of a distributed constant type filter device can be determined based on a relative dielectric constant of a part made of a different material, so that the dimension can be an appropriate size that is easy to manufacture.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

First Embodiment

Figures 3A, 3B, 3C:
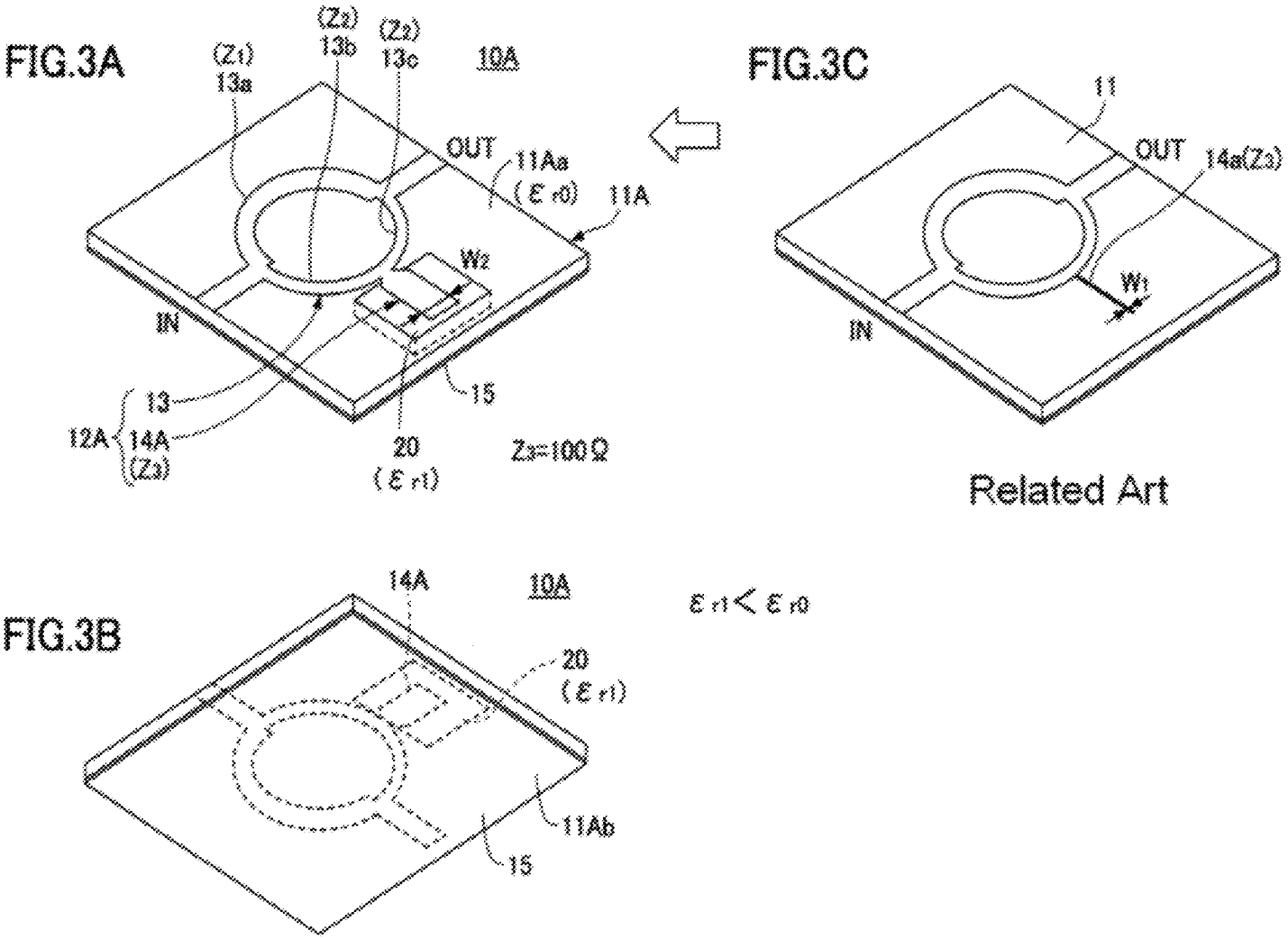
Related Art FIG.3A
FIGS. 3A, 3B are schematic diagrams of a ring filter device according to a first embodiment of the present invention.
FIG. 3C is a schematic diagram of a conventional ring filter device.

FIGS. 3A, 3B are schematic diagrams of a ring filter device 10A according to a first embodiment of the present invention, which is a distributed constant type filter device. In FIGS. 3A, 3B, elements corresponding to those in FIGS. 1A, 1B are denoted by the same reference numbers.

Figure 1A:
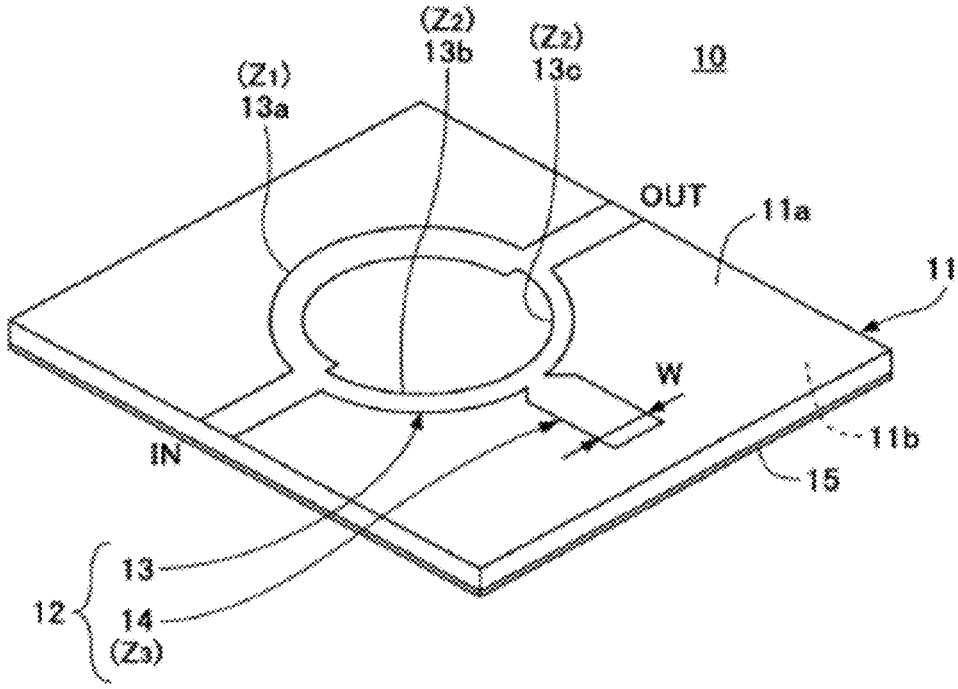
Related Art FIG.1A
FIGS. 1A, 1B are schematic diagrams of a conventional ring filter device.
Figure 1B:
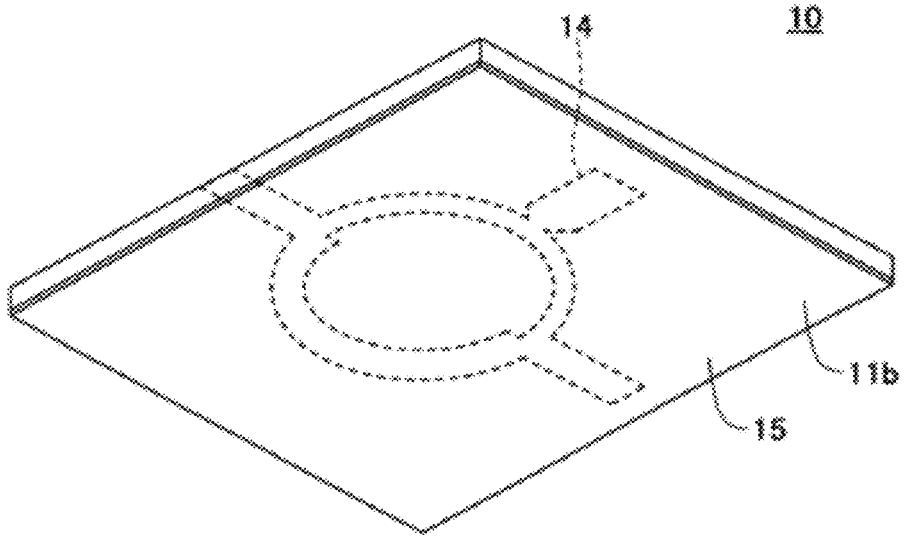
Related Art FIG.1B
Figure 2:
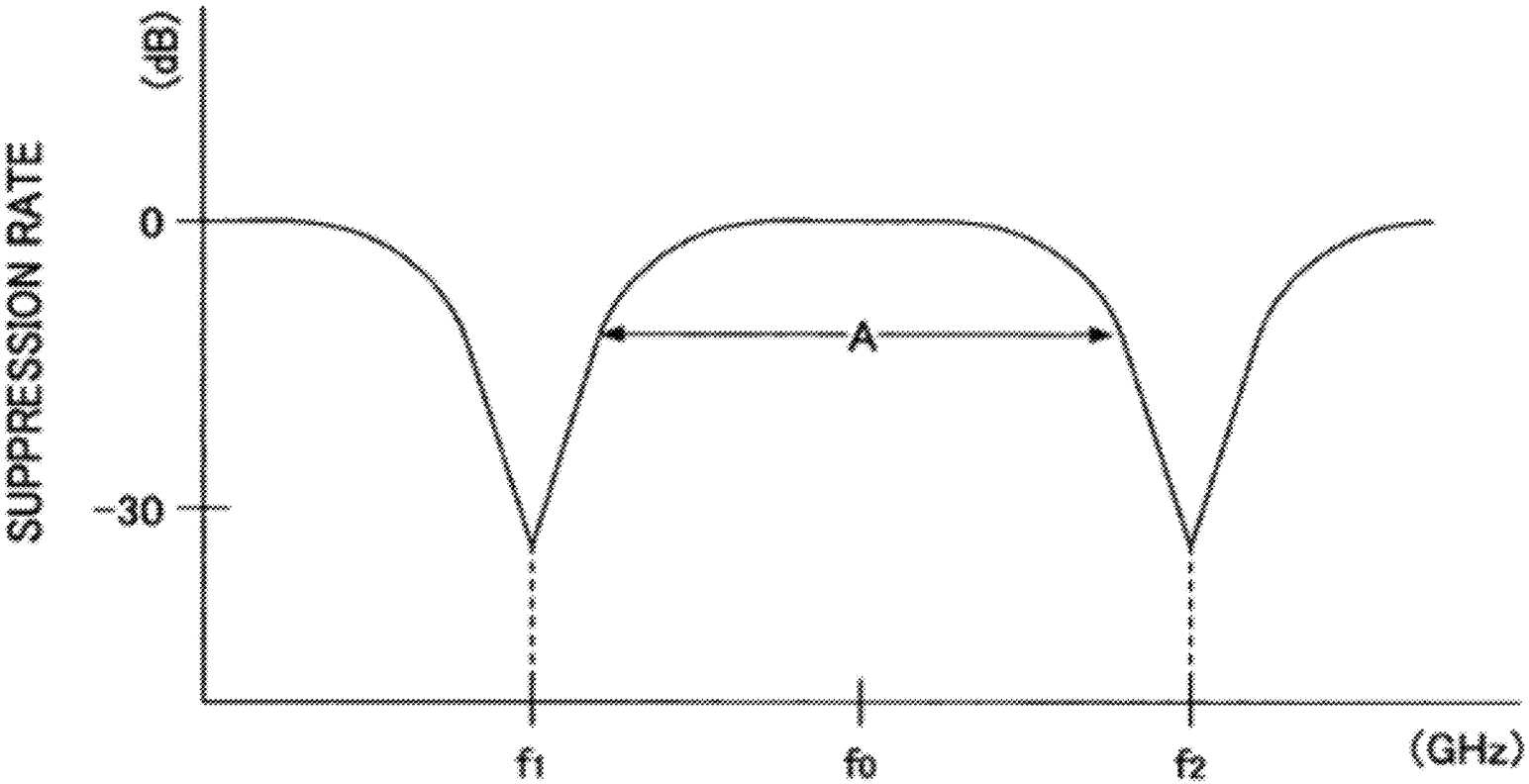
FIG.2 Related Art
FIG. 2 is a transmission property diagram of the ring filter device shown in FIGS. 1A, 1B.

The ring filter device 10A includes a substrate 11A made of dielectric, and has a different configuration to that of the ring filter device 10 shown in FIGS. 1A, 1B. In the ring filter device 10A, a ring filter element 12A having an open stub made of copper foil is arranged on a top surface 11Aa of the substrate 11A. The ground pattern 15 made of copper foil entirely covers a bottom surface 11Ab of the substrate 11A.

An open stub part 14A of the ring filter device 10A is designed to have a high impedance Z3 of, e.g. 100Ω, so as to narrow the frequency band A.

The substrate 11A is made of a dielectric epoxy resin (relative dielectric constant (∈r0)). The open stub part 14A is formed on a dielectric fluororesin part 20, which is made of a different material from that of the substrate 11A. A relative dielectric constant (∈r1) of fluororesin is lower than the relative dielectric constant (∈r0) of epoxy resin, thereby satisfying ∈r1<∈r0.

FIG. 3C is an example where the entire substrate is made of epoxy resin, and the impedance Z3 of an open stub part 14*a* is designed to be 100Ω. A width W1 of the open stub part 14*a* is narrow, e.g., 0.1 mm.

However, in the first embodiment, the relative dielectric constants satisfy ∈r1<∈r0; therefore, a width W2 of the open stub part 14A can be increased by several mm as shown in FIG. 3A, so as to have an appropriate width that is easy to manufacture.

Figure 4A:
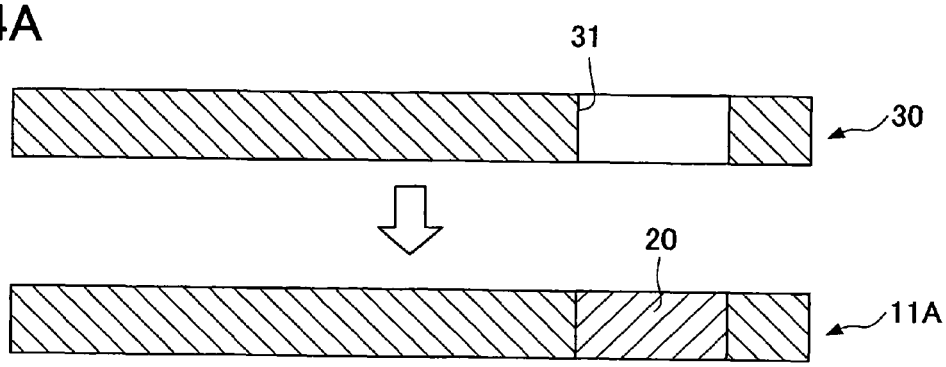
FIGS. 4A, 4B are diagrams for describing a manufacturing method of a substrate shown in FIGS. 3A, 3B.

When the substrate 11A is manufactured by injection molding, coinjection molding is employed. As shown in FIG. 4A, epoxy resin is first injected to form a substrate body 30 made of epoxy resin having an aperture 31. Next, fluororesin is supplied into the aperture 31 to form the fluororesin part 20, thereby manufacturing the substrate 11A.

Figure 4B:
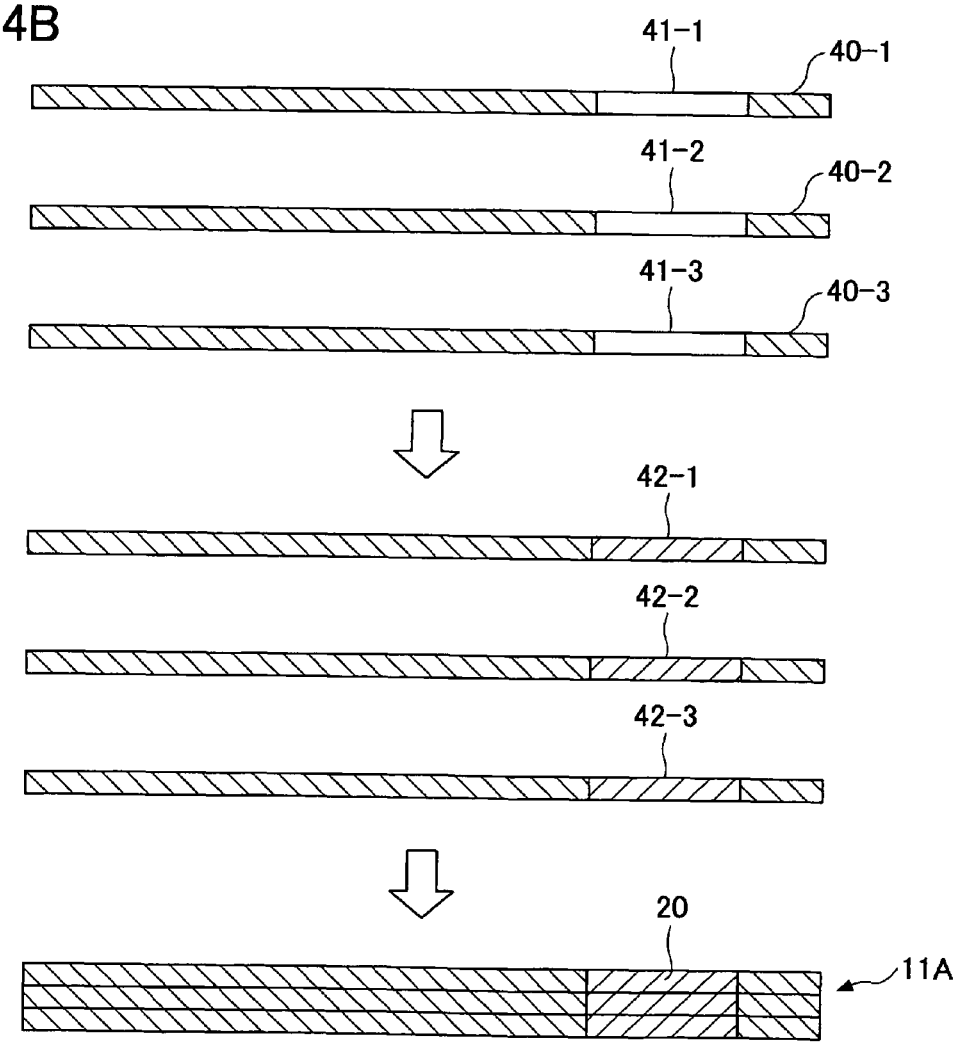

The substrate 11A can also be manufactured by the same steps performed for manufacturing a printed wiring board, by laminating plural pre-impregnated layers (hereinafter referred to as "prepreg"). Specifically, as shown in FIG. 4B, prepreg sheets 40-1, 40-2, 40-3 having apertures 41-1, 41-2, 41-3 are prepared, fluororesin is supplied into the apertures as denoted by 42-1, 42-2, 42-3, and the prepreg sheets are then laminated onto each other, thereby manufacturing the substrate 11A.

Second Embodiment

Figures 5A, 5B, 5C:
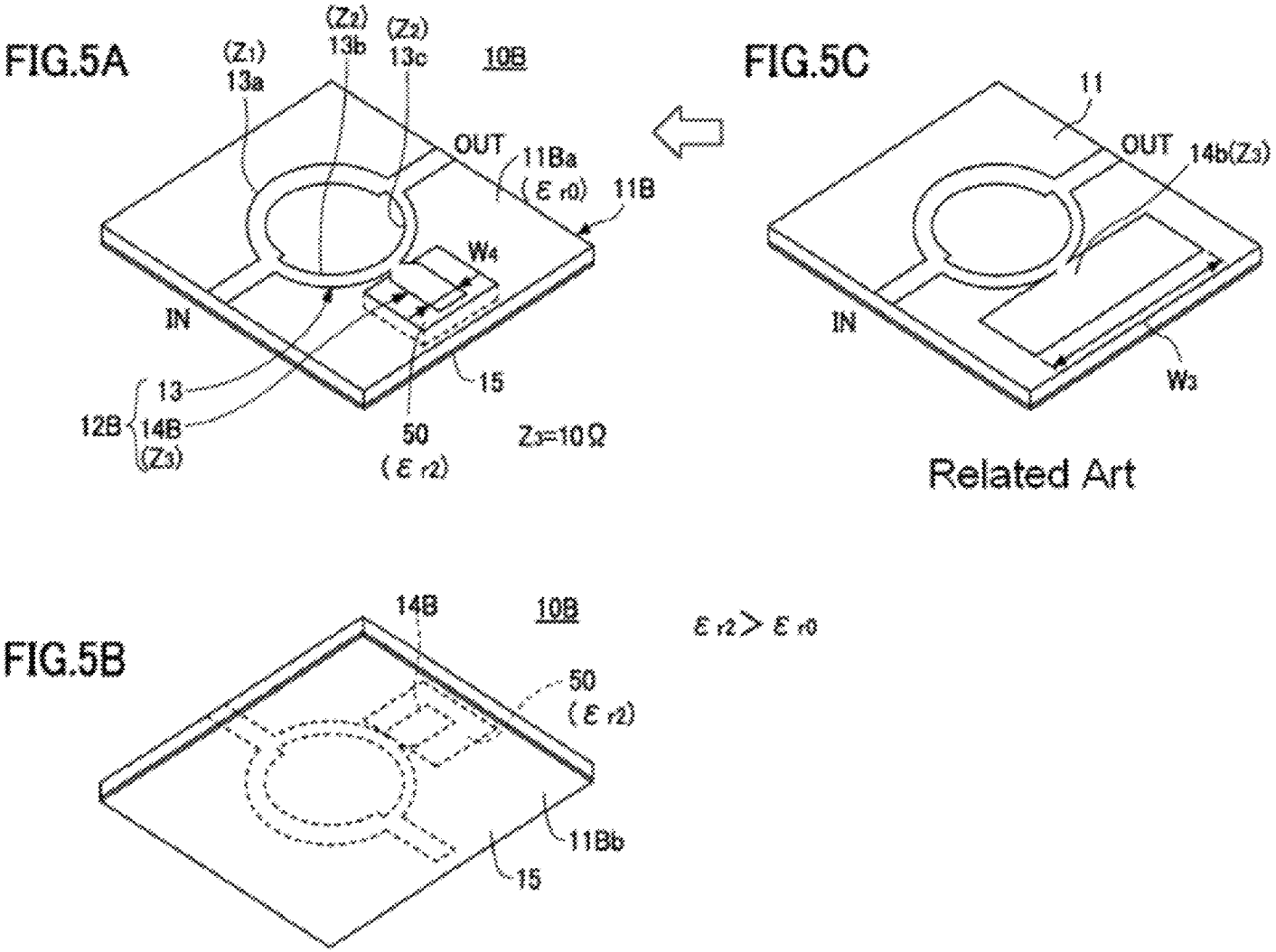
Related Art FIG.5A
FIGS. 5A, 5B are schematic diagrams of a ring filter device according to a second embodiment of the present invention.
FIG. 5C is a schematic diagram of a conventional ring filter device.

FIGS. 5A, 5B are schematic diagrams of a ring filter device 10B according to a second embodiment of the present invention. In FIGS. 5A, 5B, elements corresponding to those in FIGS. 1A, 1B are denoted by the same reference numbers.

The ring filter device 10B includes a substrate 11B made of dielectric, and has a different configuration to that of the ring filter device 10 shown in FIGS. 1A, 1B. In the ring filter device 10B, a ring filter element 12B having an open stub is arranged on a top surface 11Ba of the substrate 11B. The ground pattern 15 entirely covers a bottom surface 11Bb of the substrate 11B.

An open stub part 14B of the ring filter device 10B is designed to have a low impedance Z3 of, e.g. 10Ω, so as to widen the frequency band A.

The substrate 11B is made of a dielectric epoxy resin (relative dielectric constant (∈r0)). The open stub part 14B is formed on a dielectric PPO part 50, which is made of a different material from that of the substrate 11B. A relative dielectric constant (∈r2) of PPO is higher than the relative dielectric constant (∈r0) of epoxy resin, thereby satisfying ∈r2>∈r0. PPO is an abbreviation of polyphenylene oxide.

FIG. 5C is an example where the entire substrate is made of epoxy resin, and the impedance Z3 of an open stub part 14*b* is designed to be 10Ω. A width W3 of the open stub part 14*a* is extremely wide, e.g., 20 mm.

However, in the second embodiment, the relative dielectric constants satisfy ∈r2>∈r0; therefore, a width W4 of the open stub part 14B can be decreased by several mm as shown in FIG. 5A, so as to have an appropriate width that is easy to manufacture.

Third Embodiment

Figure 6A:
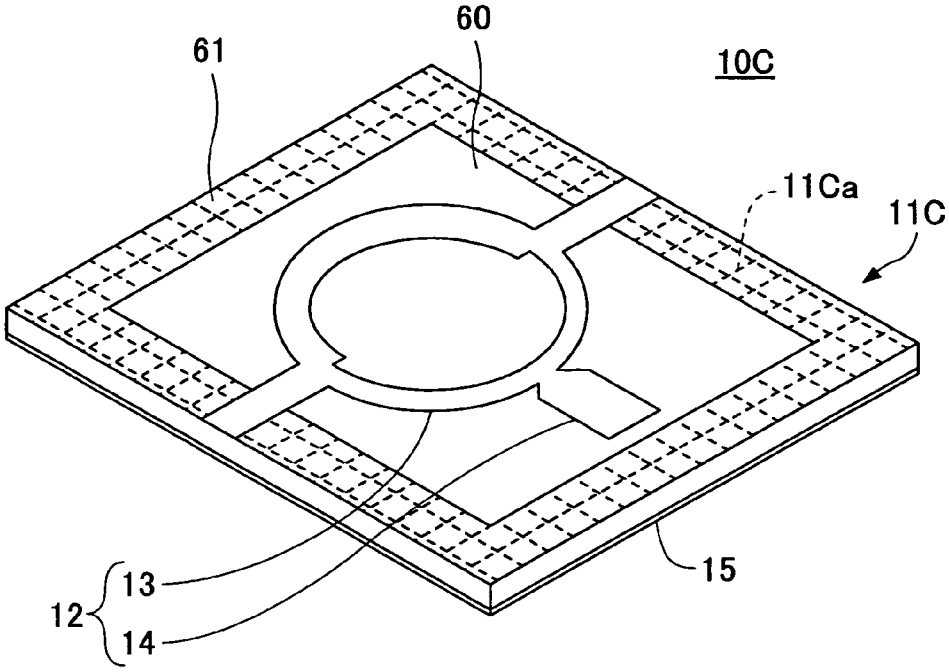
FIGS. 6A, 6B are schematic diagrams of a ring filter device according to a third embodiment of the present invention.
Figure 6B:
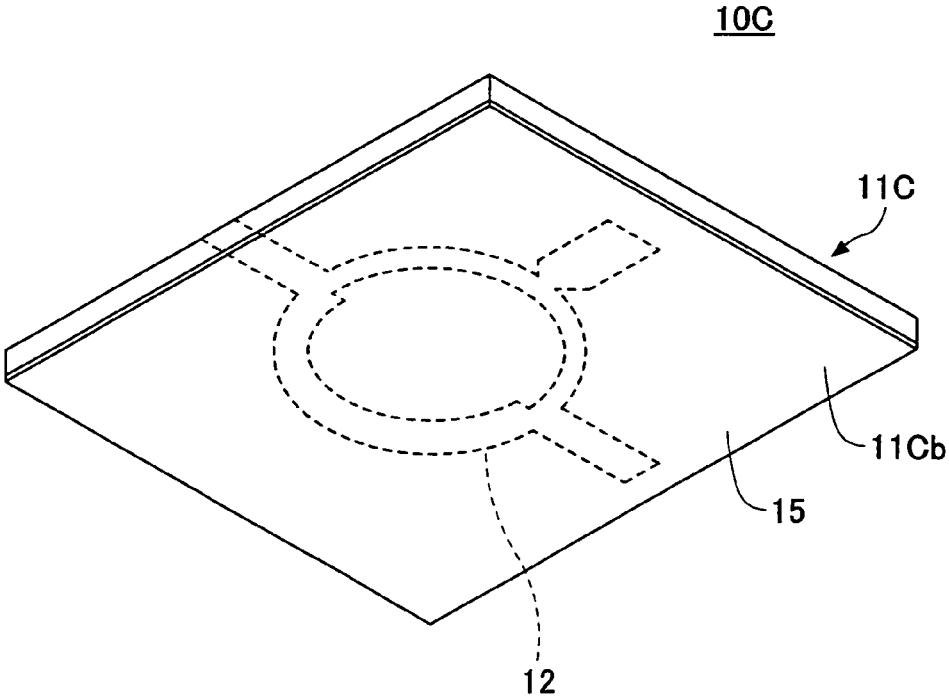

FIG. 6A, 6B are schematic diagrams of a ring filter device 10C according to a third embodiment of the present invention. In FIGS. 6A, 6B, elements corresponding to those in FIGS. 1A, 1B are denoted by the same reference numbers.

The ring filter device 10C includes a substrate 11C made of dielectric, and has a different configuration to that of the ring filter device 10 shown in FIGS. 1A, 1B. In the ring filter device 10C, the ring filter element 12 having an open stub is arranged on a top surface 11Ca of the substrate 11C. The ground pattern 15 entirely covers a bottom surface 11Cb of the substrate 11C. The ring filter element 12 having the open stub includes the ring part 13 and the open stub part 14.

The substrate 11C is formed by laminating special prepreg sheets, and a glass cloth is only included in a peripheral part thereof. Accordingly, the substrate 11C includes a part without glass cloth 60. The part without glass cloth 60 is square-shaped. The peripheral part corresponds to a part with glass cloth, which is denoted by 61. Each of the prepreg sheets is formed by impregnating a glass cloth with epoxy resin.

Figure 7:
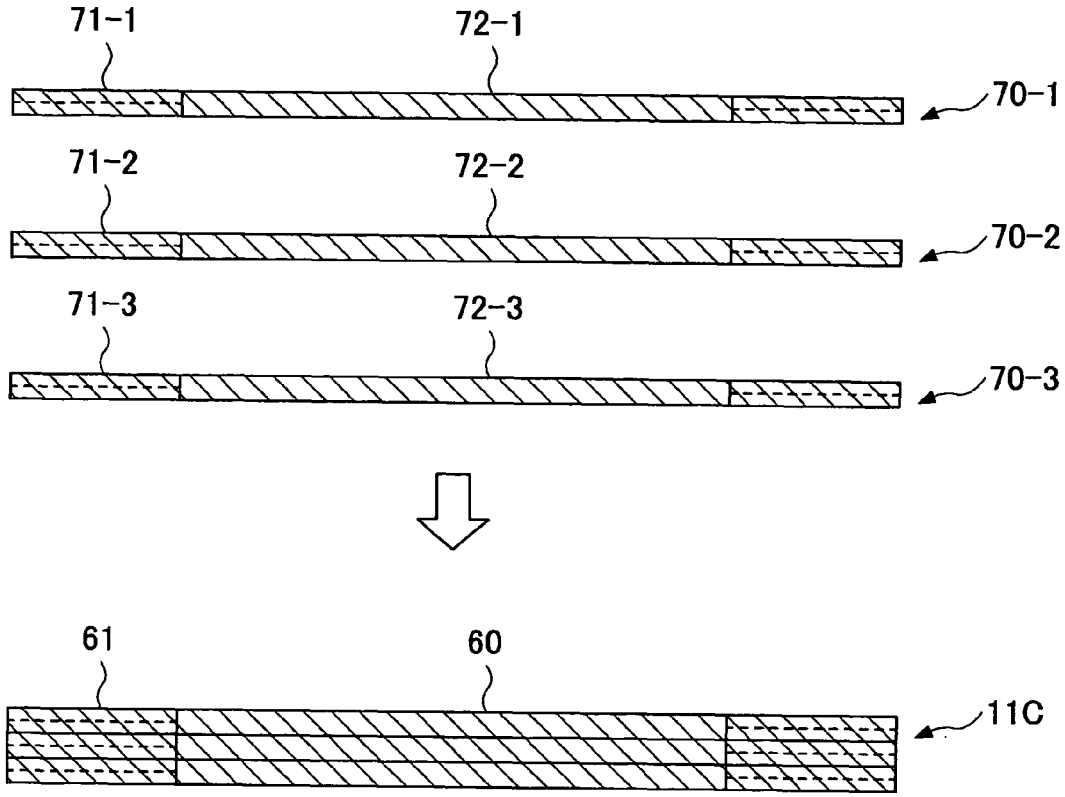
FIG. 7 is a diagram for describing a manufacturing method of a substrate shown in FIGS. 6A, 6B.

As shown in FIG. 7, the substrate 11C is manufactured by forming special prepreg sheets 70-1, 70-2, 70-3 having portions where glass cloths are not formed, and laminating the prepreg sheets onto each other. Parts denoted by 71-1, 71-2, 71-3 include glass cloths; parts denoted by 72-1, 72-2, 72-3 are made of epoxy resin, and do not include glass cloths. The part without glass cloth 60 is formed by laminating the parts 72-1, 72-2, 72-3 onto each other.

The ring part 13 and the open stub part 14 are formed on the part without glass cloth 60.

The glass cloth causes instabilities in the dielectric constant and dielectric loss of the substrate 11C, increases the dielectric loss of the substrate 11C, and forms convexities and concavities on the surface of the substrate 11C.

The part without glass cloth 60 only includes epoxy resin, and is therefore unaffected by the glass cloth, so that the dielectric constant is stable, the dielectric loss is low, and the flatness of the surface is good.

The dielectric constant is stable and the dielectric loss is low in the part without glass cloth 60, and therefore, the ring filter device 10C has a desired transmission property near design value.

Further, the surface of the part without glass cloth 60 has good flatness, and therefore, the ring part 13 and the open stub part 14 made of copper foil have good flatness. Thus, a current loss along the surface of the ring part 13 and the open stub part 14 is reduced compared to a case where the flatness is not good. Accordingly, the ring filter device 10C has a desired transmission property near design value.

The ring filter device can be made with a composite epoxy substrate instead of the dielectric substrate 11C. The surface of the composite epoxy substrate has good flatness, so that current loss along the surface is reduced. Therefore, the ring filter device can have a desired transmission property near design value.

Fourth Embodiment

Figure 8A:
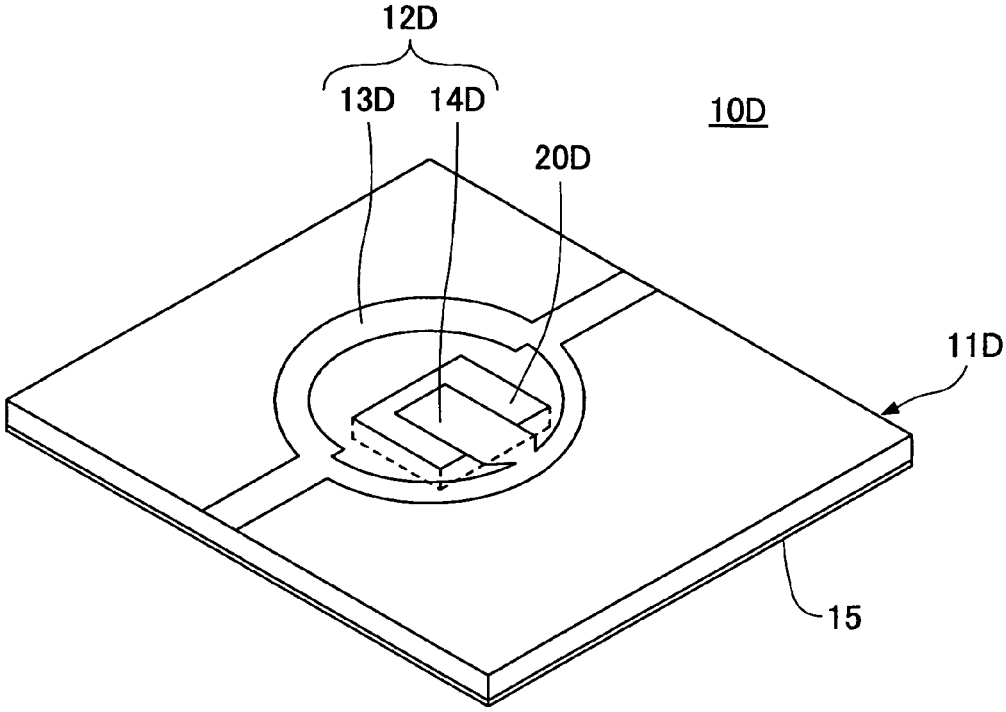
FIGS. 8A, 8B are schematic diagrams of a ring filter device according to a fourth embodiment of the present invention.
Figure 8B:
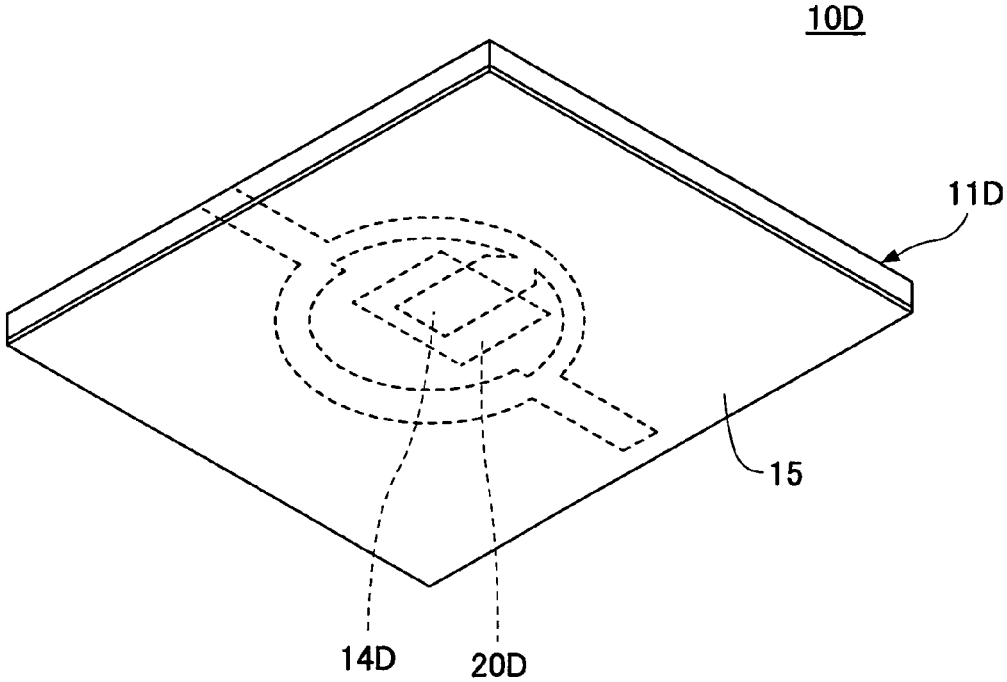

FIG. 8A, 8B are schematic diagrams of a ring filter device 10D according to a fourth embodiment of the present invention. In FIGS. 8A, 8B, elements corresponding to those in FIGS. 1A, 1B are denoted by the same reference numbers.

In the ring filter device 10D, a ring filter element 12D having an open stub is arranged on a top surface of a substrate 11D. The ground pattern 15 entirely covers the bottom surface of the substrate 11D. The ring filter element 12D having the open stub includes a ring part 13D and an open stub part 14D. The open stub part 14D protrudes into the ring part 13D. The open stub part 14D is formed on a fluororesin part 20D of the substrate 11D.

In the ring filter device 10D, the width of the open stub part 14D can be made to have an appropriate dimension. Further, the ring filter device 10D can be made compact than other examples where the open stub part protrudes out from the ring part.

Fifth Embodiment

Figure 9:
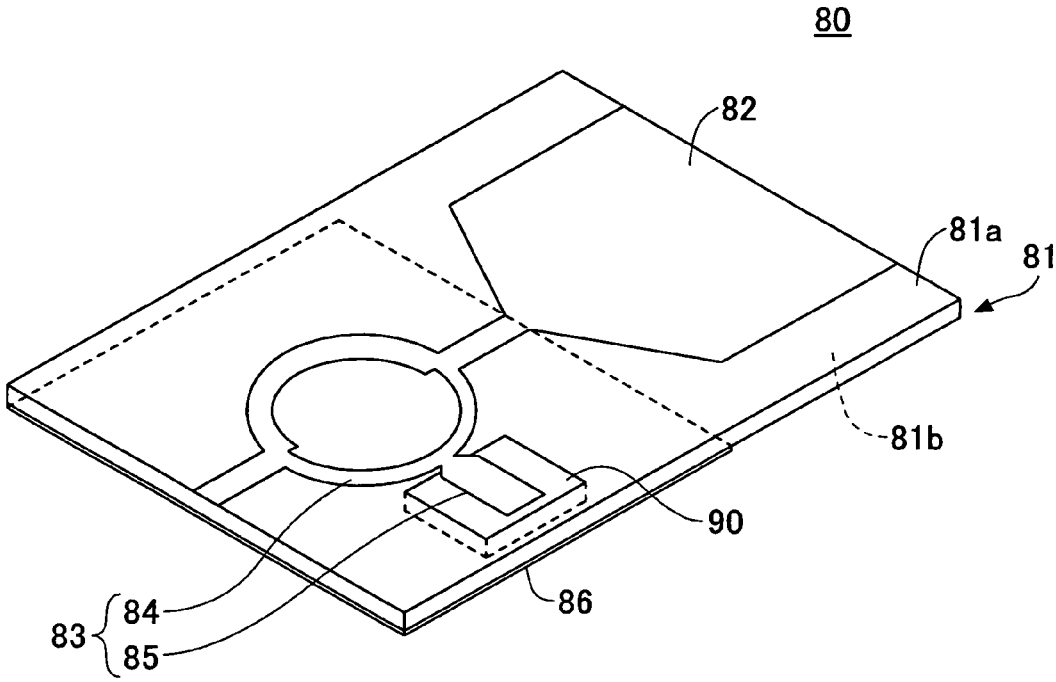
FIG. 9 is a schematic diagram of a UWB flat panel antenna device according to a fifth embodiment of the present invention.

FIG. 9 is a schematic diagram of a UWB flat panel antenna device 80 according to a fifth embodiment of the present invention. The UWB flat panel antenna device 80 includes a home base shaped antenna element pattern 82 and a ring filter element 83 having an open stub, arranged on a top surface 81*a* of a substrate 81 made of epoxy resin.

The ring filter element 83 having an open stub includes a ring part 84 and an open stub part 85.

The UWB flat panel antenna device 80 includes a fluororesin part 90. The open stub part 85 is formed on the fluororesin part 90, and has an appropriate width that is easy to manufacture, so that the freedom in the design of the UWB flat panel antenna device 80 is higher than conventional products.

Sixth Embodiment

Figure 10A:
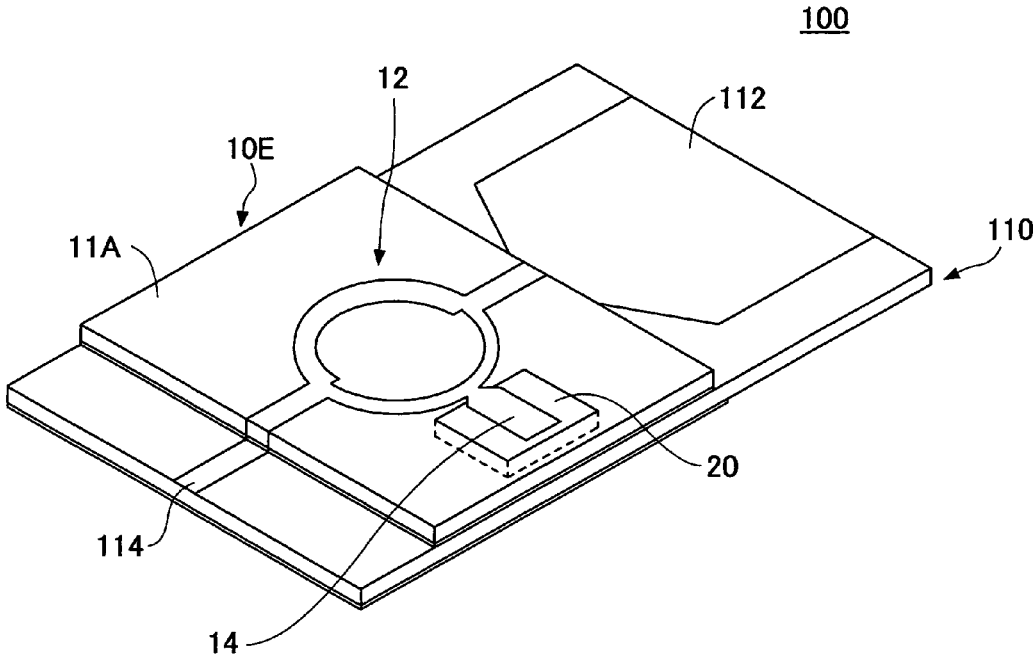
FIGS. 10A, 10B are schematic diagrams of a UWB flat panel antenna device according to a sixth embodiment of the present invention.
Figure 10B:
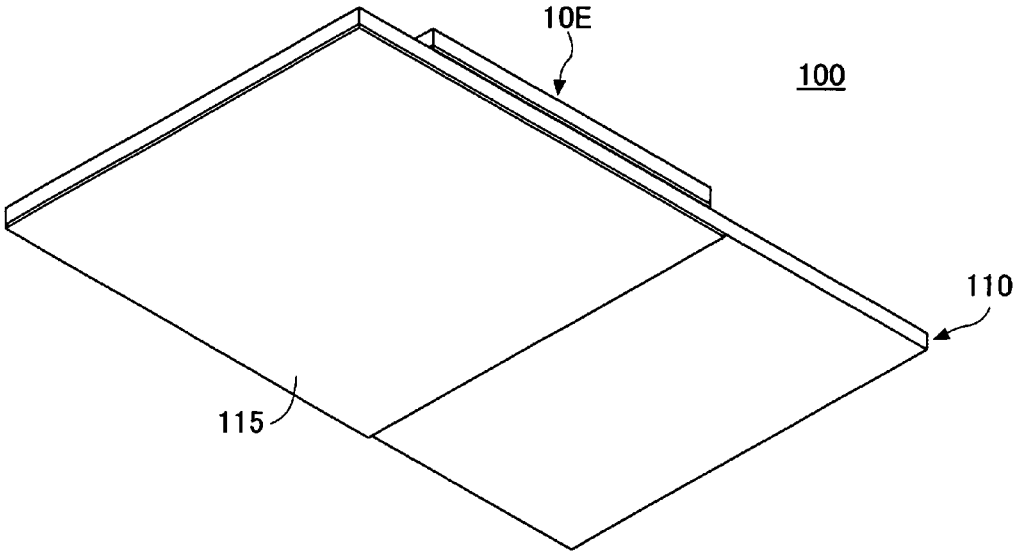
Figure 11:
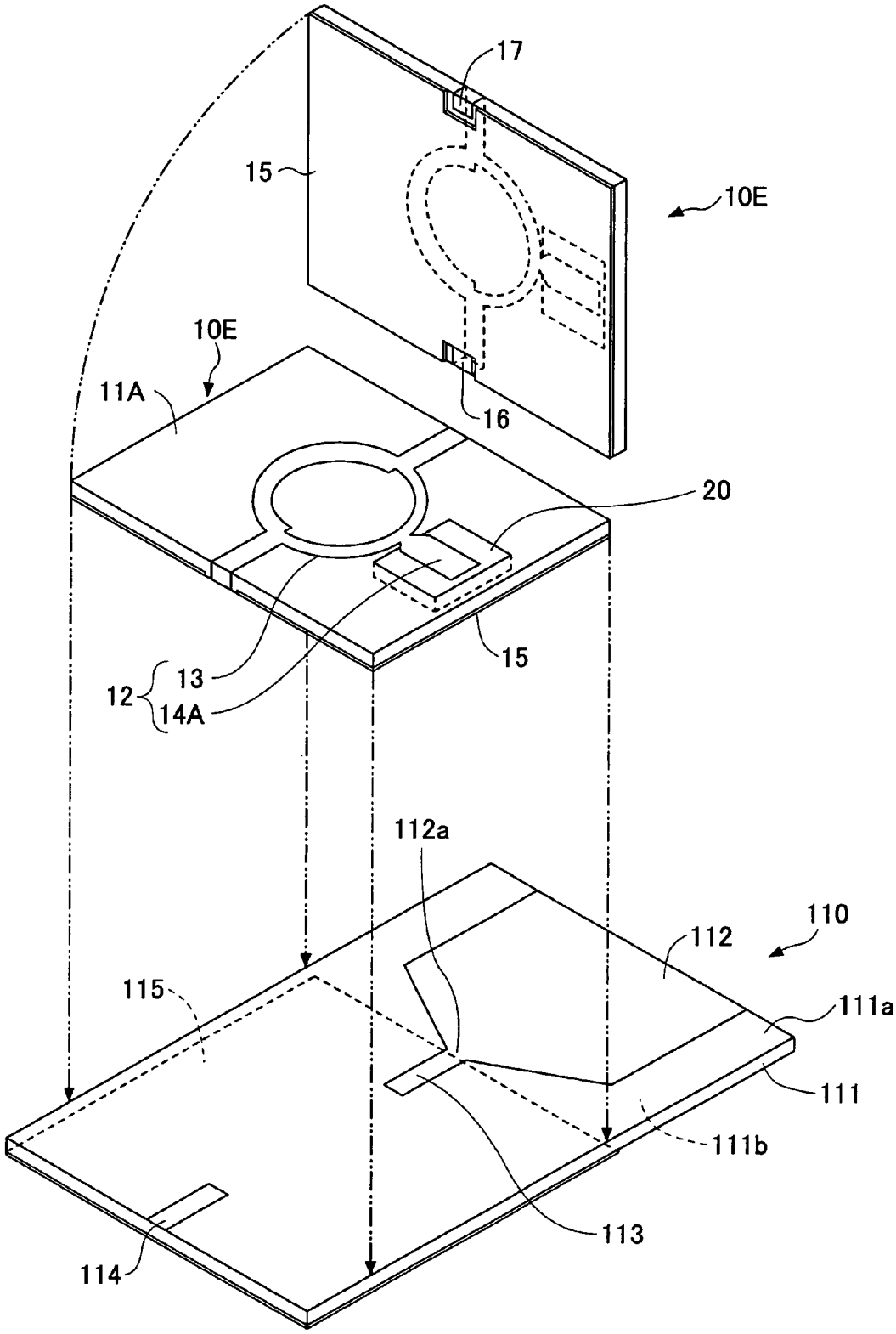
FIG. 11 is schematic diagram of the UWB flat panel antenna device shown in FIGS. 10A, 10B in a disassembled status.

FIGS. 10A, 10B are schematic diagrams of a UWB flat panel antenna device 100 according to a sixth embodiment of the present invention. FIG. 11 is schematic diagram of the UWB flat panel antenna device 100 in a disassembled status.

The UWB flat panel antenna device 100 includes a ring filter device 10E mounted on the top surface of a flat panel antenna body 110.

As shown in FIG. 11, the flat panel antenna body 110 includes an antenna element pattern 112 and lines 113, 114 formed on a top surface 111*a* of a substrate 111 made of dielectric. A square-shaped ground pattern 115 is formed on a bottom surface 111*b* of the dielectric substrate 111. The line 113 extends from a projecting portion (power feeding point) 112*a* of the antenna element pattern 112.

The ring filter device 10E is substantially the same as the ring filter device 10A shown in FIGS. 3A, 3B, and elements corresponding to those in FIGS. 3A, 3B are denoted by the same reference numbers. The ring filter device 10E has lines 16, 17 extending to the underside thereof.

The ring filter device 10E is mounted onto the position between the line 113 and the line 114, with the line 16 connected to the line 113 and the line 17 connected to the line 114.

Seventh Embodiment

Figure 12:
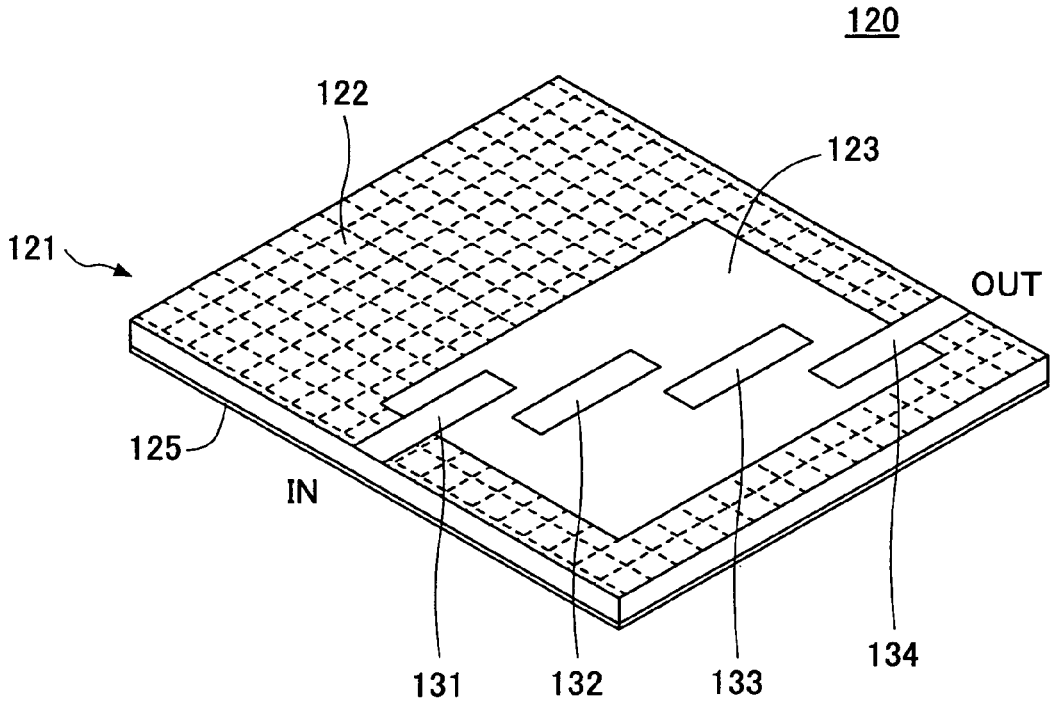
FIG. 12 is a schematic diagram of an edge coupled filter device according to a seventh embodiment of the present invention.

FIG. 12 is a schematic diagram of an edge coupled filter device 120 according to a seventh embodiment of the present invention.

A substrate 121 is formed by laminating special prepreg sheets, and a glass cloth is only included in a periphery part 122 thereof. Accordingly, the substrate 121 includes a part without glass cloth 123.

On the top surface of the substrate 121, microstrip lines 131, 132, 133, 134 are formed in parallel, partly overlapping one another. A ground pattern 125 entirely covers the bottom surface of the substrate 121.

The coupling constants between the microstrip line 131 and the microstrip line 132, the microstrip line 132 and the microstrip line 133, and the microstrip line 133 and the microstrip line 134 are controlled by distances and overlapping amounts therebetween, thereby achieving a desired frequency property.

The microstrip lines 131, 132, 133, 134 are formed on the part without glass cloth 123.

The part without glass cloth 123 has a stable dielectric constant and a low rate of dielectric loss. Therefore, the edge coupled filter device 120 has a desired transmission property near design value.

Further, the surface of the part without glass cloth 123 has good flatness, and therefore, surfaces of the microstrip lines 131, 132, 133, 134 made of copper foil have good flatness. Thus, a current loss along the surface of the microstrip lines 131, 132, 133, 134 is reduced compared to a case where the flatness is not good. Accordingly, the edge coupled filter device 120 has a desired transmission property near design value.

The present invention is not limited to the specifically disclosed embodiment, and variations and modifications may be made without departing from the scope of the present invention.

The present application is based on Japanese Priority Patent Application No. 2006-131700, filed on May 10, 2006, the entire contents of which are hereby incorporated by reference.

What is claimed is:

1. A distributed constant type filter comprising:

a substrate including a plurality of laminated pre-preg layers, each pre-preg layer including a part made of a first dielectric material having a first relative dielectric constant and a different-material part made of a second dielectric material having a second relative dielectric constant different from the first relative dielectric constant;

a filter pattern formed on a top surface of the substrate; and a ground pattern formed on a bottom surface of the substrate; wherein a part of the filter pattern is formed on the different-material part, wherein the filter pattern includes a ring part and an open stub part connected to the ring part, the open stub part is formed on the different-material part, the first dielectric material consists of an epoxy resin, and the second dielectric material consists of a single compound dielectric material, wherein the first dielectric material and the second dielectric material of each pre-preg layer form a separate coinjected integration, wherein a relative dielectric constant relationship between the first dielectric material and the second dielectric material is satisfied so as to allow the open stub part to have a width which provides greater ease in manufacture.

2. The distributed constant type filter of claim 1, wherein the second relative dielectric constant is lower than the first relative dielectric constant.

3. The distributed constant type filter of claim 1, wherein the different-material part is a dielectric fluororesin.

4. A distributed constant type filter comprising:

a substrate made of a dielectric material;

a filter pattern formed on a top surface of the substrate; and a ground pattern formed on a bottom surface of the substrate; wherein the filter pattern includes a ring part, in/out connection lines connected to the ring part, and a single open stub part connected to the ring part, the single open stub part extends from the ring part inward to an interior of the circle of the ring part, the ring part includes a first transmission line having a length $\lambda/2$, and two second transmission lines, each having a length $\lambda/4$, where $\lambda$ corresponds to a wavelength of a frequency, the single open stub part extends inward to the interior of the circle of the ring part from between the two second transmission lines, the single open stub part is integrally formed with the ring part as one piece, and the single open stub part and the in/out connection lines are on a same plane as the ring part, and the single open stub part is formed having a width which is the easiest to manufacture and provides an optimum ring part compactness.

* * * * *

UNITED STATES PATENT AND TRADEMARK OFFICE

CERTIFICATE OF CORRECTION

PATENT NO. : 8,164,400 B2
APPLICATION NO. : 11/589167
DATED : April 24, 2012
INVENTOR(S) : Iwata It is certified that error appears in the above-identified patent and that said Letters Patent is hereby corrected as shown below:

On the Title Page, Item "[75] Inventors", Change "Shigemi Kurashima, Shingawa (JP);" to -- Shigemi Kurashima, Shinagawa (JP); --.

On the Title Page, Item "[75] Inventors", Change "Takashi Yuba, Shingawa (JP);" to -- Takashi Yuba, Shinagawa (JP); --.

In the Claims

Column 8, lines 24-25, Claim 4, Change "is the easiest to" to -- provides greater ease in --.

Signed and Sealed this
Thirteenth Day of May, 2014

Michelle K. Lee

Michelle K. Lee
*Deputy Director of the United States Patent and Trademark Office*